US005653072A

United States Patent [19]

Seelandt-Stasek et al.

[11] Patent Number: 5,653,072

[45] Date of Patent: Aug. 5, 1997

[54] UNIVERSAL WINDOW SILL TRAY

[76] Inventors: Lisa Seelandt-Stasek; Joseph Stasek, Jr., both of 4 Claire Ct., Matawan, N.J. 07747

[21] Appl. No.: 310,383

[22] Filed: Sep. 22, 1994

[51] Int. Cl.[6] ..... E06B 1/04; E06B 1/56

[52] U.S. Cl. ..... 52/204.1; 52/98; 52/100; 52/204.5; 52/217

[58] Field of Search ..... 52/204.1, 97, 98, 52/100, 204.5, 209, 211, 217, 656.5, 656.6, 717.01, 717.02, 717.05, 727, 728, 204.58, 204.53

[56] References Cited

U.S. PATENT DOCUMENTS

| | | | |
|---|---|---|---|
| 3,605,356 | 9/1971 | Bordner | 52/97 |
| 3,638,372 | 2/1972 | Rosenthal | 52/97 |
| 3,919,815 | 11/1975 | Alabaster | 52/204.1 X |
| 4,193,238 | 3/1980 | Chalmers et al. | 52/204.53 |
| 4,335,550 | 6/1982 | Johnson | 52/204.1 X |
| 4,492,062 | 1/1985 | Levenez | 52/211 X |
| 4,555,882 | 12/1985 | Moffitt et al. | 52/209 |
| 4,682,451 | 7/1987 | Hubble | 52/97 |
| 4,782,630 | 11/1988 | Kleyn | 52/217 X |
| 5,134,822 | 8/1992 | Edlin | 52/100 X |
| 5,148,644 | 9/1992 | Weir | 52/97 X |
| 5,157,881 | 10/1992 | Tashman et al. | 52/656.6 X |
| 5,222,345 | 6/1993 | Riley | 52/801 |

FOREIGN PATENT DOCUMENTS

| | | | |
|---|---|---|---|
| 2431583 | 3/1980 | France | 52/100 |
| 0387909 | 5/1965 | Switzerland | 52/100 |

*Primary Examiner*—Wynn E. Wood

[57] ABSTRACT

A tray for protecting exterior portions of a sill of a window. The inventive device includes a planar member positionable over the sill. A flange depends from a front edge of the planar member to tray the front face of the sill. Frangible grid areas extend along laterally opposed sides of the planar member for permitting a selective removal of portions of the lateral sides to customize the device to a particular window. The tray is removable for easy cleaning and can be inserted and removed from inside the associated house or building.

2 Claims, 4 Drawing Sheets

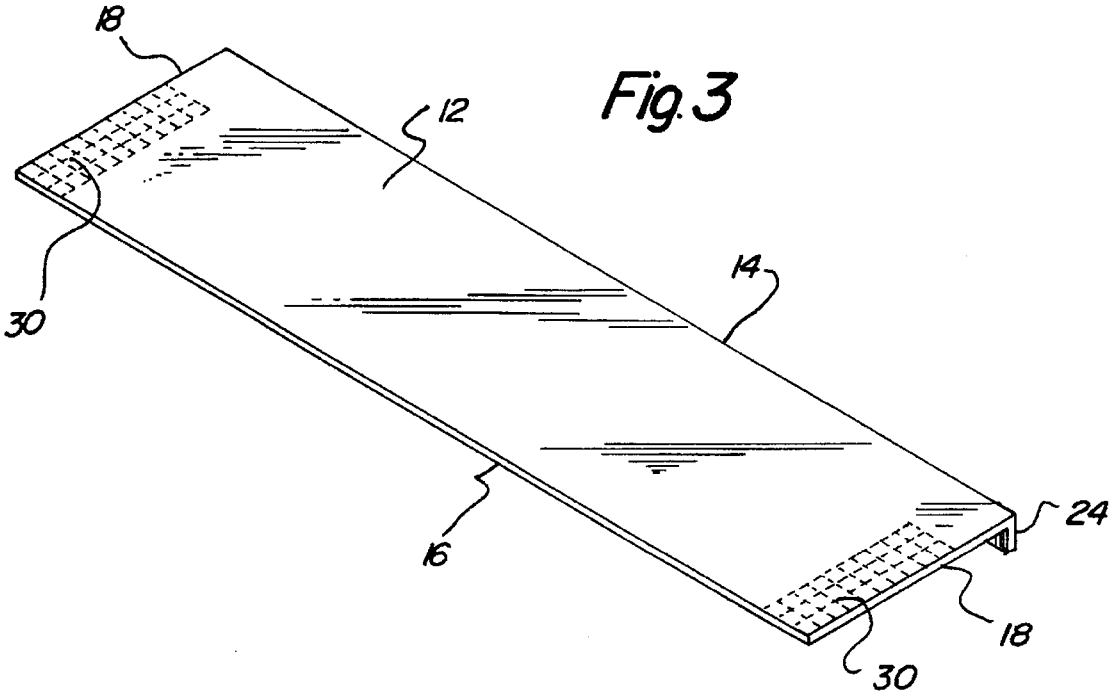
Fig. 3
Fig. 4
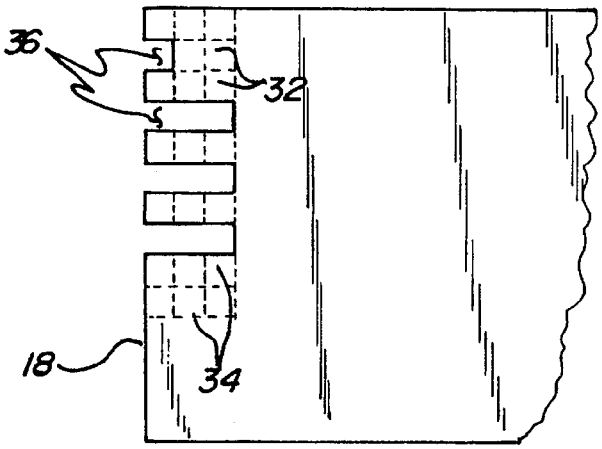

UNIVERSAL WINDOW SILL TRAY

BACKGROUND OF THE INVENTION

1. Field of the Invention

The present invention relates to tray structures and more particularly pertains to a universal window sill tray for protecting the sill of a window.

2. Description of the Prior Art

The use of tray structures is known in the prior art. More specifically, tray structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art tray structures include U.S. Pat. No. 4,682,451; U.S. Pat. No. 4,897,958; U.S. Pat. No. 3,605,356; U.S. Pat. No. 4,492,062; U.S. Pat. No. 4,555,882; U.S. Pat. No. D,338,428 and U.S. Pat. No. D,338,637.

While these devices fulfill their respective, particular objectives and requirements, the aforementioned patents do not disclose a universal window sill tray for protecting a sill of a window which includes a planar member positionable over the sill, and a flange depending from a front edge of the planar member to tray the front face of the sill, with frangible grid areas extending along laterally opposed sides of the planar member for permitting a selective removal of portions of the lateral sides to customize the device to a particular window.

In these respects, the universal window sill tray according to the present invention substantially departs from the conventional concepts and designs of the prior art, and in so doing provides an apparatus primarily developed for the purpose of protecting a sill of a window.

SUMMARY OF THE INVENTION

In view of the foregoing disadvantages inherent in the known types of tray structures now present in the prior art, the present invention provides a new universal window sill tray construction wherein the same can be utilized for protecting a sill of window. As such, the general purpose of the present invention, which will be described subsequently in greater detail, is to provide a new universal window sill tray apparatus and method which has many of the advantages of the tray structures mentioned heretofore and many novel features that result in a universal window sill tray which is not anticipated, rendered obvious, suggested, or even implied by any of the prior art tray structures, either alone or in any combination thereof.

To attain this, the present invention generally comprises a tray for protecting a sill of a window. The inventive device includes a planar member positionable over the sill. A flange depends from a front edge of the planar member to tray the front face of the sill. Frangible grid areas extend along laterally opposed sides of the planar member for permitting a selective removal of portions of the lateral sides to customize the device to a particular window.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new universal window sill tray apparatus and method which has many of the advantages of the tray structures mentioned heretofore and many novel features that result in a universal window sill tray which is not anticipated, rendered obvious, suggested, or even implied by any of the prior art tray structures, either alone or in any combination thereof.

It is another object of the present invention to provide a new universal window sill tray which may be easily and efficiently manufactured and marketed.

It is a further object of the present invention to provide a new universal window sill tray which is of a durable and reliable construction.

An even further object of the present invention is to provide a new universal window sill tray which is susceptible of a low cost of manufacture with regard to both materials and labor, and which accordingly is then susceptible of low prices of sale to the consuming public, thereby making such universal window sill trays economically available to the buying public.

Still yet another object of the present invention is to provide a new universal window sill tray which provides in the apparatuses and methods of the prior art some of the advantages thereof, while simultaneously overcoming some of the disadvantages normally associated therewith.

Still another object of the present invention is to provide a new universal window sill tray for protecting a sill of window from contact with exterior elements.

Yet another object of the present invention is to provide a new universal window sill tray which includes a planar member positionable over the sill, and flange depending from a front edge of the planar member to tray the front face of the sill, with frangible grid areas extending along laterally opposed sides of the planar member for permitting a selective removal of portions of the sides to customize the sides to a particular window.

Even still another object of the present invention is to provide a new universal window sill tray which utilizes fabric fasteners to secure the tray to the window sill.

Even still yet another object of the present invention is to provide a new universal window sill tray which can be easily inserted and removed from an associated window for cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the present invention including frangible grid areas.

FIG. 4 is an enlarged plan view of a portion of the invention.

DESCRIPTION OF THE PREFERRED EMBODIMENT

Figure 2:
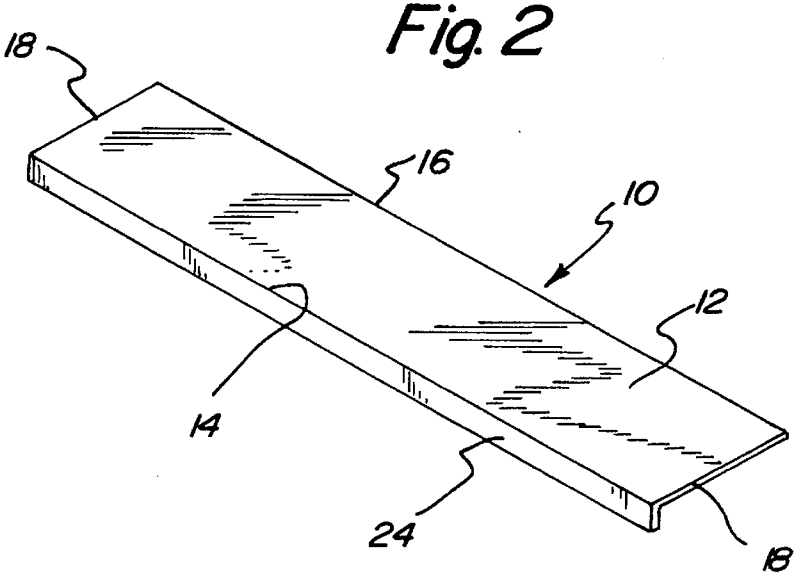
FIG. 2 is a further isometric illustration of the window sill tray, per se.

With reference now to the drawings, and in particular to FIGS. 1–6 thereof, a new universal window sill tray embodying the principles and concepts of the present invention and generally designated by the reference numeral 10 will be described.

More specifically, it will be noted that the universal window sill tray 10 comprises a substantially rectangular planar member 12 having a straight front edge 14 spaced from a rear edge 16. Preferably, the rear edge 16 is also substantially straight and aligned parallel to the front edge 14, as shown in FIG. 2. The planar member 12 further includes a pair of lateral edges 18 extending between the front and rear edges 14, 16. The lateral edges 18 are preferably oriented orthogonally relative to the front and rear edges 14, 16 so as to define the substantially rectangular shape of the planar member 12.

Figure 1:
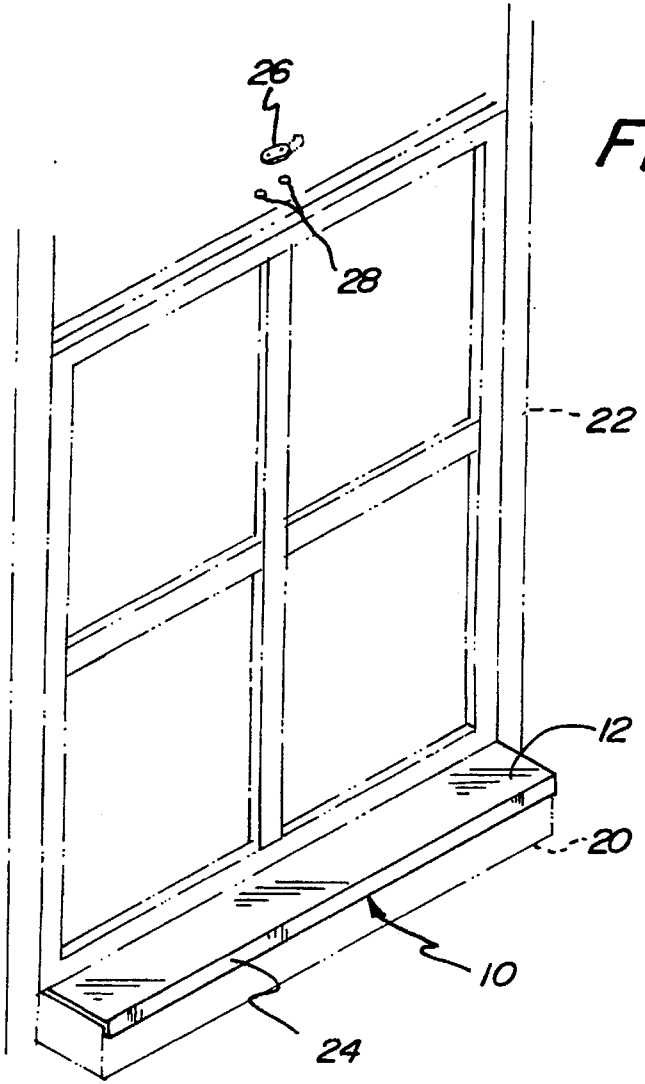
FIG. 1 is an isometric illustration of a universal window sill tray according to the present invention as installed to a window.

As shown in FIG. 1, the planar member 12 is operable to extend coextensively along a sill 20 of the window 22 to protect the upper surface of the sill 20 from damage thereto. To the protect the front face of the sill 20, the depending flange 24 extends downwardly from the front edge 14 of the planar member 12, as shown in FIG. 2. The depending flange 24 is preferably coextensive along a longitudinal length of the planar member 12 and may tray an entire front face of the sill 20, or alternatively, the depending flange may tray only a portion of the front face of the sill, as in FIG. 1. The planar member 12 is operable to extend between the sill 20 and a lower edge of a sliding frame of the window 22 such that the planar member is captured between the upper surface of the sill 20 and a lower portion of the sliding frame. To permit a window lock 26 of the window 22 to be operated with the planar member 12 positioned between the upper surface of the sill 20 and the lower surface of the sliding frame, a plurality of washers 28 may be inserted between the window lock and an upper surface of the siding frame so as to provide a clearance between the sliding frame and the sill necessary for the planar member to extend therebetween.

Turning now to FIGS. 3 and 4, it can be shown that the present invention 10 may advantageously include frangible area means 30 extending along the planar member 12 proximal to the respectfully opposed lateral edges 18 thereof for customizing the tray to fit a particular window. The frangible area means 30 each comprise a plurality of transverse score lines 32 intersected by a plurality of longitudinal score lines 34 which cooperate to form a grid of such score lines. The score lines 32 and 34, permit portions of the planar member 12 to be selectively removed by cutting or breaking to define a plurality of cut-outs 36 extending from the respective lateral edge 18 and into the planar member 12. The cut-outs 36 can shaped so as to correspondingly receive portions of the window 22 to further retain the universal window sill tray 10 relative to the sill 20 when the sliding frame of the window is in an open configuration. In other words, the cut-outs 36 are operable to engage the sliding track structures located on either side of the window 22, whereby such engagement of the cut-outs to the interior track structure of the window 22 will retain the window sill tray 10 in a desired position. To this end, the window sill tray 10 can be inserted through the window opening at an oblique angle relative to the sill 20 and subsequently rotated into a horizontal position parallel to the sill to allow the cut outs 36 to engage the track structures, whereby the planar member 12 can than be positioned flatly against the top surface of the sill. By this structure, the universal window sill tray 10 can be selectively customized to fit any particular window.

Figure 5:
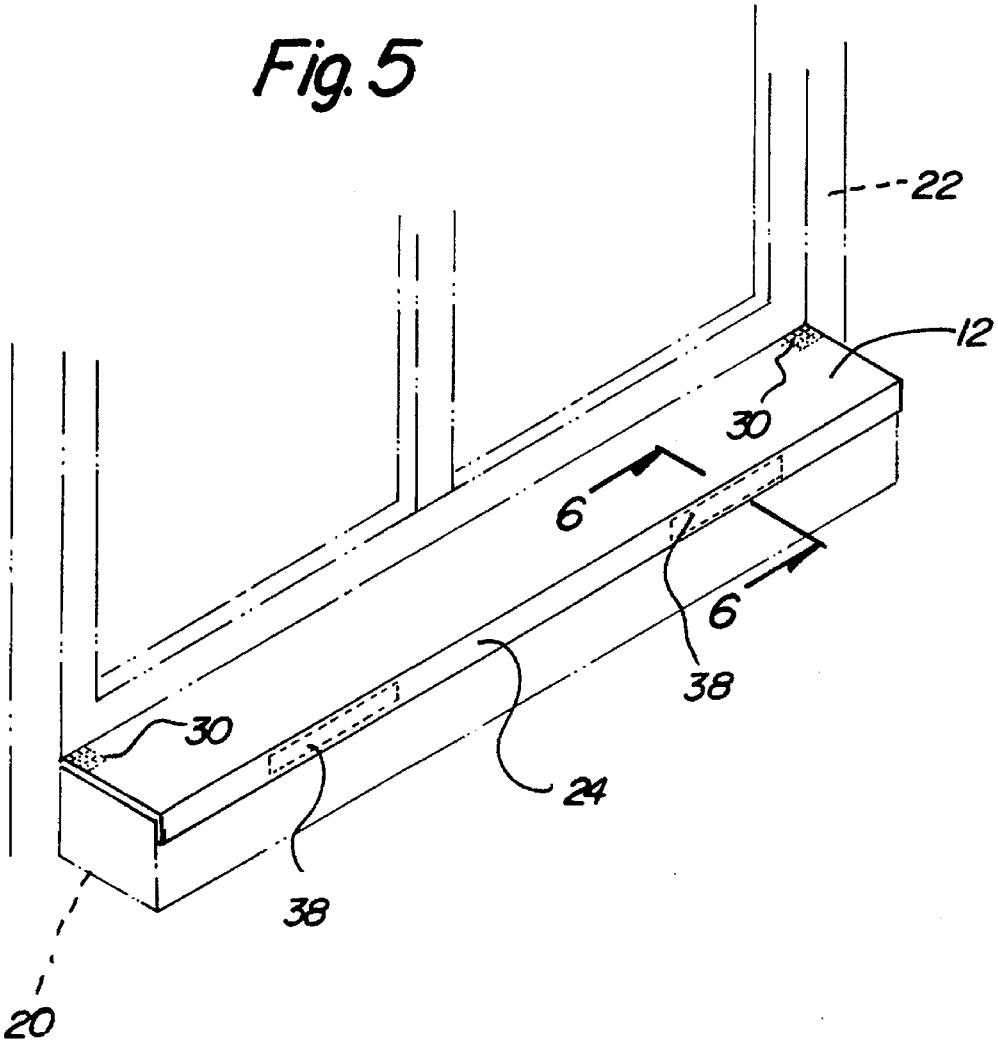
FIG. 5 is an isometric illustration of the sill tray including fastening means.
Figure 6:
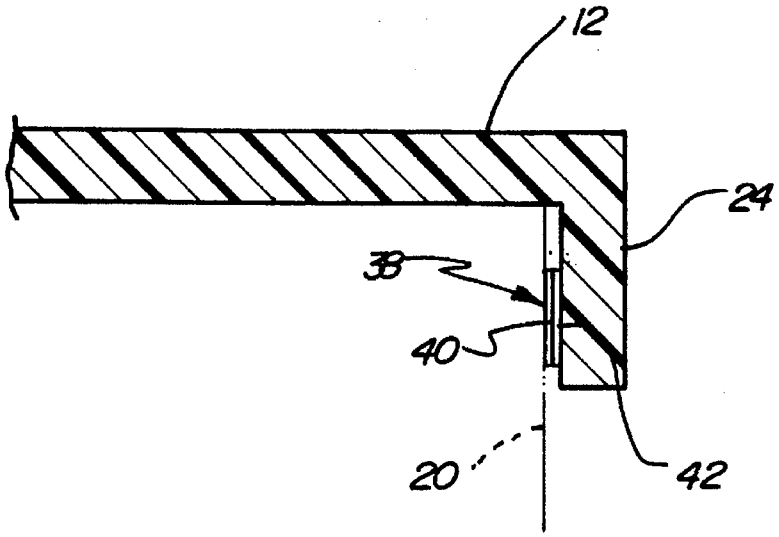
FIG. 6 is a cross sectional view taken along lines 6—6 of FIG. 5.

FIGS. 5 and 6 illustrate the addition of a fastening means 38 to the present 10 for further securing the sill tray to the sill 20. To this end, the fastening means 38 preferably comprises a fabric fastener, such as the trademarked fastener "VELCRO", with hook material 40 being secured to the front face of the sill 20, as shown in FIG. 6, and pile material 42 being secured to an interior surface of the depending flange 24. By this structure, the sill tray 10 is precluded from unintentional disengagement with the sill 20 in absence of, or in addition to, the frangible areas 30. While it is within the intent and purview of the present invention to position the fastening means 38 between the planar member 12 and the upper surface of the sill 20, it is preferable that the fastening means 38 be positioned between the depending flange 24 and the front face of the sill 20, as shown in FIG. 6. Such positioning of the fastening means 38 between the depending flange 24 and the front face of the sill 20 provides for several advantages. First, the additional thickness of the hook material and pile material 40, 42 does not interfere with the clearance afforded between the lower portion of the sliding frame of the window 22 and the upper surface of the sill 20. Secondly, an upward force on the window sill tray 10 relative to the window 22 will result in a lateral sliding of the pile material 42 relatively to the hook material 40, wherein the strength of the fastening means 38 is much greater than a pulling of the pile material 42 relative to the hook material.

Figure 7:
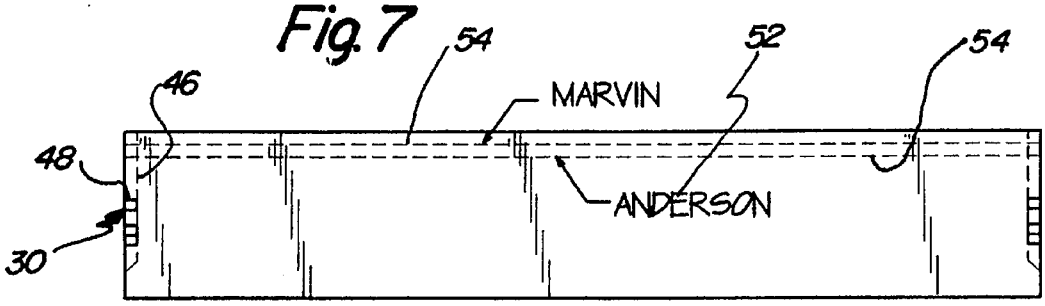
FIG. 7 is a top plan view of the tray illustrating an alternative form of the frangible grid means.
Figure 8:
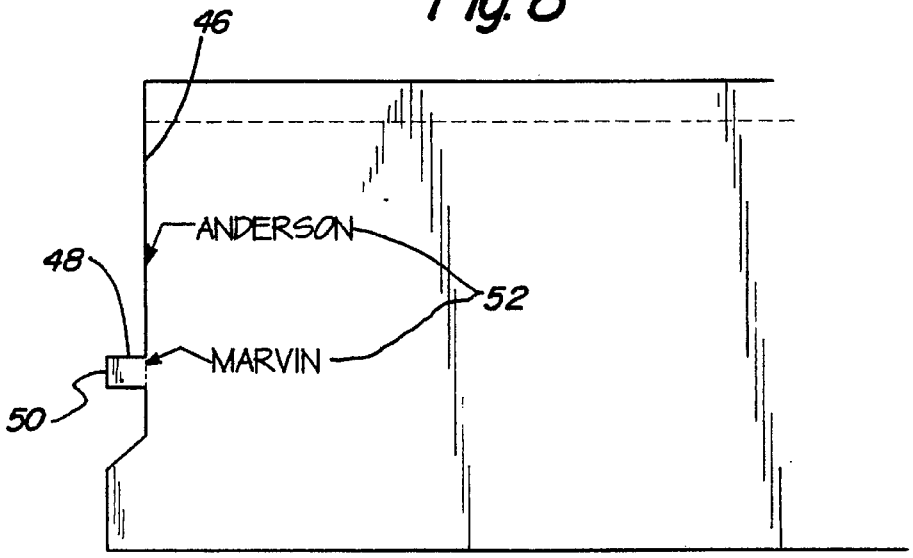
FIG. 8 is a top plan view of the tray illustrating the alternative form of the frangible grid means after separation of a portion thereof.
Figure 9:
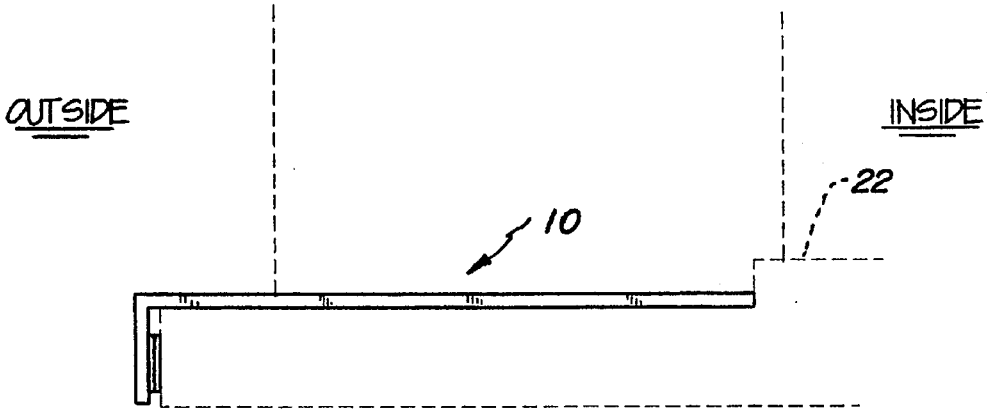
FIG. 9 is a side view illustrating the placement of the tray along the lower portion of a window so as to cover an exterior portion of the sill.

FIGS. 7 through 9 illustrate an alternative frangible area means 30 for customizing the device 10 to a particular window, and it can be shown that the frangible area means 30 of the present invention 10 may advantageously comprise a single transverse score line 46 intersected by a plurality of longitudinal score lines 48 which cooperate to form a grid of such score lines. The score lines 46 and 48 permit portions of the planar member 12 to be selectively removed by cutting or breaking to define at least one projection 50 extending from the respective lateral edge 18 of the planar member 12. The projection 50 can shaped so as to correspondingly enter the tracks of a particular window. Accordingly, indicia 52 can be provide to direct an end user to the proper cutting of the device 10 for a particular window. Further, the alternative frangible area means 30 may additionally comprise elongated score lines 54 which permit a longitudinal strip of material to be removed from the planar member 12 to customize a transverse width of the device 10 to the particular window. Such longitudinal score lines 54 can also include directive indicia 52 (shown enlarged in FIG. 7 for clarity) to indicate to the end user the proper areas to break or cut.

In use, the universal window sill tray 10 may be conveniently installed within any window from an interior of the associated building or house by simply raising the sliding frame of the window and inserting the planar member 12 therethrough into the orientation shown in FIG. 1 to position the device 10 along an exterior portion of the window sill as shown in FIG. 9. Further, the frangible area means 30 may be priorly customized to fit within the track structure of the particular window, wherein unintentional removal Of the sill tray 10 is substantially precluded. To further secure the sill tray 10 to the window sill 20, the fastening means 38 may additionally be utilized. The window sill tray 10 can be constructed of any conceivable material, such as a plastic material or the like and may include ornamental indicia thereon, such as flowers, or other decorative patterns. Alternatively, the device 10 may be comprised of a substantially transparent material wherein the color of the sill 20 can be seen therethrough.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A universal window sill tray comprising: a planar member having a straight front edge spaced from a rear edge, said planar member further having a pair of lateral edges extending between said front and rear edges; a depending flange extending downwardly from said front edge of said planar member, and; frangible area means extending along the planar member proximal to said opposed lateral edges thereof, said frangible area means permitting portions of said planar member to be selectively removed to define a plurality of cut-outs extending from said respective lateral edge and into said planar member, wherein said frangible area means comprises a plurality of transverse score lines formed into said planar member and intersected by a plurality of longitudinal score lines formed into said planar member which cooperate to form a grid of score lines, and further comprising a fastening means provided only on said depending flange for securing said sill tray to a window sill, wherein said fastening means comprises a fabric fastener, with a first portion of said fabric fastener being secured to an interior surface of said depending flange, and a second portion of said fabric fastener being removably secured to said first portion of said fabric fastener and securable to a front face of said sill.

2. A universal window sill tray comprising:

a substantially rectangular planar member having a straight front edge spaced from a straight rear edge, said planar member further having a pair of lateral edges extending between said front and rear edges, said lateral edges being oriented orthogonally relative to said front and rear edges so as to define a substantially rectangular shape of said planar member, said planar member being positionable on a sill of a window so as to extend coextensively along said sill to protect an upper surface of said sill;

a depending flange extending downwardly from said front edge of said planar member extending coextensive along a longitudinal length of said planar member;

frangible area means extending along said planar member proximal to said respectfully opposed lateral edges thereof for permitting portions of said planar member to be selectively removed to define a plurality of cut-outs extending from said respective lateral edge and into said planar member, said frangible area means comprising a plurality of transverse score lines formed in said planar member and intersected by a plurality of longitudinal score lines formed in said planar member which cooperate to form a grid of score lines, said score lines permitting portions of said planar member to be selectively removed to define a plurality of cut-outs extending from said respective lateral edges and into said planar member, said cut-outs being indexed to receive sliding track structures of said window to retain said universal window sill tray relative to said sill when a sliding frame of said window is in an open configuration; and, a fastening means provided only on said depending flange for further securing said sill tray to said sill, said fastening means comprising a fabric fastener, with a first portion of said fabric fastener being secured to an interior surface of said depending flange, and a second portion of said fabric fastener being removably secured to said first portion of said fabric fastener and securable to a front face of said sill.

* * * * *